US006165630A

United States Patent [19]

Gehlhaar et al.

[11] Patent Number: 6,165,630

[45] Date of Patent: Dec. 26, 2000

[54] GALVANIZED ALUMINUM SHEET

[75] Inventors: Horst Gehlhaar, Andernach, Germany; Martinus Godefridus Johannes Spanjers, IJmuiden, Netherlands; Joop Nicolaas Mooij, Castricum, Netherlands; Wilhelmus Jacobus Van Der Meer, Amsterdam, Netherlands

[73] Assignee: Corus Bausysteme GmbH, Koblenz, Germany

[21] Appl. No.: 09/180,024

[22] PCT Filed: May 7, 1997

[86] PCT No.: PCT/EP97/02329

§ 371 Date: Apr. 8, 1999

§ 102(e) Date: Apr. 8, 1999

[87] PCT Pub. No.: WO97/43467

PCT Pub. Date: Nov. 20, 1997

[30] Foreign Application Priority Data

May 13, 1996 [NL] Netherlands ..... 1003090

[51] Int. Cl.[7] ..... C25D 5/44; C25F 3/04

[52] U.S. Cl. ..... 428/658; 428/629; 428/935; 205/172; 205/177; 205/103; 205/214

[58] Field of Search ..... 428/650, 658, 428/935, 472.2, 629; 205/214, 139, 153, 103, 172, 177

[56] References Cited

U.S. PATENT DOCUMENTS

| | | |
|---|---|---|
| 4,225,397 | 9/1980 | Napier . |
| 4,272,342 | 6/1981 | Oda et al. . |
| 4,547,274 | 10/1985 | Ohasi et al. . |
| 5,176,963 | 1/1993 | Koyama et al. . |
| 5,234,574 | 8/1993 | Tsuji et al. . |
| 5,245,847 | 9/1993 | Bando et al. . |

FOREIGN PATENT DOCUMENTS

| | | |
|---|---|---|
| 52-005630 | 1/1977 | Japan . |

*Primary Examiner*—Deborah Jones
*Assistant Examiner*—Jason Savage
*Attorney, Agent, or Firm*—Stevens, Davis, Miller & Mosher, L.L.P.

[57] ABSTRACT

A method for applying a zinc layer onto an aluminum or aluminum alloy sheet, comprising pretreating the surface and applying the layer by electrolytic galvanizing, the pretreating comprises electrochemical graining of the surface, for example in a solution having a pH less than 3 with an alternating current applied between the sheet and an electrode. In an alternative method, the pretreating includes applying a preliminary zinc layer by immersing the surface in a zinc-containing alkaline solution, applying a potential to the sheet and reversing the polarity of said potential at least once. The sheets are useful for building cladding sheets and automotive panels.

23 Claims, No Drawings

GALVANIZED ALUMINUM SHEET

TECHNICAL FIELD

The invention relates to methods for applying a layer comprising zinc onto at least one surface of an aluminum or aluminum alloy sheet, comprising in succession a pretreatment step and an electrolytic galvanizing step. The invention also relates to the galvanized aluminum or aluminum alloy sheet produced by the methods, and the use of such sheet in building structures and as automotive body sheet. In the following description, for brevity we refer to aluminum sheets, but this term is to be understood to include aluminum alloy sheets.

BACKGROUND ART

Aluminum sheet is used on a wide scale in building structures as interior and/or exterior panels of buildings both for facade and roofing structures. An advantage of this is that the low specific weight of the aluminum means that the building structure may be made considerably lighter than for example with steel sheet. A disadvantage of untreated aluminum sheet is that the building structure reflects a large amount of light which limits its application in the immediate vicinity or airfields, for example. A solution to this problem is to provide the aluminum sheet with a surface layer, for example zinc, while retaining the structural advantages. An advantage of a galvanized aluminum sheet is that it reflects less light and has good corrosion resistance. A further advantage of galvanized aluminum sheet is that the building structure made with it requires little maintenance due to the durability of the AlZn system. A further advantage of galvanized aluminum sheet is that the appearance of the aluminum sheet changes slowly over time, i.e. it "lives". This last property, the so-called patina effect, is much sought after by architects for application in buildings of their design. Galvanizing the aluminum sheet considerably increases the applicability of the aluminum sheet.

Methods of electrolytically plating zinc onto aluminum (galvanizing) are well known. To improve the applied zinc layer, pretreatments of the aluminum surface have been proposed.

JP-A-52005630 discloses electroplating one of Cu, Ni, Zn, Sn, Pb, Cd and Cr onto the chemically roughened surface of an aluminum or aluminum workpiece. The roughening is performed in two stages: first in alkali pH≧11 or a fluoric acid solution, and second using a mixed mineral acid solution.

In EP-A-0497302 a pretreatment step consisting of degreasing and pickling is performed and cathodic zinc electroplating is then carried out in two steps, thereby forming two adjacent zinc layers. The layers may contain Ni or Fe additions to improve bonding.

Another method for pretreating and galvanizing an aluminum sheet is given in EP-A-0498436, which describes a method for the continuous electrolytic application of a zinc layer onto an aluminum sheet intended for processing into an automotive body sheet, after which the aluminum sheet is provided with a paint layer. The method comprises in succession the steps (i) alkaline degreasing, (ii) pickling in an acid solution, (iii) anodizing and cathodic zinc electrolysis of the aluminum sheet in the same acid solution. In between the steps the aluminum sheet is cleaned by rinsing with water. The anodization and electrolysis process is not dependent on the extent of pretreatment, which may even be omitted. A disadvantage of galvanized aluminum sheet obtained by this method is that the bonding of the applied zinc layer on the aluminum sheet is very poor when the galvanized aluminum sheet is highly deformed, for example by bending.

Zinc plating of wrought aluminum sheet as a precursor to zinc phosphate treatment and painting is described in U.S. Pat. No. 5176963. The zinc plating may comprise two stages, namely displacement plating from an alkaline bath and electroplating from an acid bath. There is no disclosure of the application of a potential to the sheet during the displacement plating stage.

DISCLOSURE OF THE INVENTION

An object of the invention is to provide a method for pretreating and galvanizing an aluminum sheet by which a very effective bond is obtained between the applied zinc layer and the aluminum sheet, the bond remaining effective under large subsequent deformation of the sheet. An additional object of the invention is that the method for pretreating and galvanizing the aluminum sheet may be carried out as a continuous process.

According to the invention in one aspect there is provided a method for applying a layer comprising zinc onto at least one surface of an aluminum or aluminum alloy sheet, comprising the steps of pretreating said surface and applying the layer by electrolytic galvanizing, characterized in that the pretreating step comprises electrochemical graining of said surface.

Electrolytic graining is a process known in the art and is one example of the technique of graining. It is known in the art (see "Study of the mechanism of the A.C. electrolytic graining of aluminum" by P. Laevers, Brussels Free University, November 1995 and EP-A-586504) to use electrolytic graining for roughening of aluminum sheet, typically an aluminum-litho sheet, but the use of graining as a pretreatment in electrolytic galvanizing of aluminum sheet is novel.

By the electrochemical graining pretreatment step of the invention an effective bond between the electrolytically applied zinc layer and the aluminum sheet is formed, the bond remaining effective during subsequent deformation of the aluminum sheet, for example by bending. It can also achieve the effect that the resulting aluminum sheet has a very good corrosion resistance. Furthermore the method may be carried out in a continuous process.

The invention is based in part on the insight that to obtain a well-bonded zinc layer on the aluminum sheet so that the bond remains effective under great deformation of the galvanized aluminum sheer, the pretreatment is extremely important. It is believed that the electrochemical graining of the aluminum sheet produces a roughened surface so that the subsequently electrolytically applied zinc layer is also mechanically bonded. This mechanical bonding is partly responsible for achieving the effect that the zinc layer remains bonded under large deformation of the galvanized aluminum sheet.

Very good results, including effective bonding of the electrolytically applied zinc layer may be obtained with graining process parameters comprising one or more of:

(a) alternating current, preferably with a frequency in the range from 10–1000 Hz, more preferably 40–100 Hz;

(b) current density of 5–200 A/dm$^2$, preferably 10–100 A/dm$^2$, and more preferably 20–50 A/dm$^2$;

(c) bath temperature 15–60° C., preferably 40–50° C.;

(d) treatment time 0.2–60 s, preferably 0.5–10 s, and more preferably 2–3 s;

(e) bath acidity pH<3, and preferably pH<2.

A further advantage is that these process parameters lend themselves to application in a continuous process operation.

As mentioned, the electrolytic graining is preferably performed in an acid solution. Various acids may be used for this, but preferably use is made of a hydrochloric acid solution or a nitric acid solution. The graining step may be a part of a pretreatment cycle. A typical preferred pretreatment cycle comprises in succession:

(1) alkaline degreasing;

(2) electrolyte graining;

(3) anodizing e.g. in a sulphate solution; and may also comprise rinsing with water between these steps. However, the method is not limited to this pretreatment cycle. Better alkaline degreasing is achieved if simultaneously a direct current is applied in a range 1–20 A/dm$^2$, preferably 5–15 A/dm$^2$.

Preferably anodizing is carried out after the electrolytic graining.

In a further aspect, the invention consists in an aluminum or aluminum alloy sheet having an electrolytically applied layer comprising zinc in which said layer is adjacent to an aluminum or aluminum alloy surface roughened by electrochemical graining. By microscopic inspection of the aluminum-zinc interface it will be possible to detect the electrolytic graining.

In a second method, the invention provides a method for applying a layer comprising zinc onto at least one surface of an aluminum or aluminum alloy sheet, comprising the steps of pretreating said surface and applying said layer by electrolytic galvanizing, said pretreating step including applying a preliminary layer comprising zinc onto said surface, characterized in that the application of said preliminary layer comprises (i) immersing said surface in a zinc-containing alkaline solution, (ii) applying a potential to the sheet to cause an electrolytic current to flow, and (iii) reversing the polarity of said potential at least once. This method may be combined with the electrolytic graining pretreatment described above.

By this method of applying a preliminary zinc layer, a very effective bond of the subsequent electrolytically applied zinc layer may thereby be obtained. An advantage of this pretreatment is that the whole pretreatment may be carried out in an alkaline solution. Thus only a single waste flow, which is alkaline, may be formed which represents a logistical advantage. In addition the aluminum sheet can be directly degreased. The entire pretreatment cycle can therefore consist essentially of one pretreatment step.

Zincate treatments are known for applying conversion layers onto aluminum, for example as known from "Oppervlaktebehandelingen van aluminum" by T. van der Klis and J. W. du Mortier published by the Vereniging voor Oppervlaktetechnieken voor Materialen, Bilthoven, NL, 3rd edition 1992, pp 406–409. A basic composition for a zincate pickle comprises 40–50 g/l ZnO and 400–500 g/l NaOH. However, a zincate treatment according to the present method, besides applying a thin zinc layer onto the aluminum sheet, also activates the surface of the aluminum sheet so that the zinc layer applied electrolytically subsequently bonds better. The thickness of the layer comprising zinc produced in the pretreatment step is not of major importance, but may be in the range 0.1 to 0.5 g/m$^2$, and the ultimate layer thickness of the zinc is essentially determined during the electrolytic galvanizing stage.

In this second method of the invention, the aluminum sheet may be anodized, e.g. in a sulphate solution, prior to the electrolytic galvanizing. This can achieve the effect that the electrolytically applied zinc layer bonds very effectively to the aluminum sheet.

In the second method of the invention, during the zincate treatment, the aluminum sheet changes polarity at least once, preferably at least twice. Thus the aluminum sheet may be initially anode-connected (A) for a given time, and then cathode-connected (C). This connection sequence may be designated A-C. The aluminum sheet is preferably anode-connected first so that a part of the oxide layer goes into solution, after which a thin zinc layer deposits onto the aluminum sheet at the time when the aluminum sheet is cathode-connected. However C-A connection is also possible. The final connection is preferably as a cathode. Preferably the aluminum sheet is connected at least A-C-A-C. The duration of maintenance of each polarity is here called the electrolysis time per polarity, and is preferably at least 0.5 s.

Very good results may be obtained with zincate process parameters comprising one or more of:

(a) bath temperature 10–60° C., preferably 20–30° C.;

(b) current density of 0.5–20 A/dm$^2$, preferably 2–10 A/dm$^2$;

(c) electrolysis time per polarity 0.5–10 s, preferably 1–4 s;

(d) total immersion time 1–30 s, preferably 2–10 s;

(e) bath composition comprising 10–300 g/l NaOH and 2–40 g/l ZnO, preferably 50–150 g/l NaOH and 5–20 g/l ZnO.

An advantage of these process parameters is that the pretreatment process lends itself well to application in a continuous process operation.

Following the pretreatment according to both methods of the invention the aluminum sheet is electrolytically galvanized in an acid solution. Conventional galvanizing techniques may be used, and many different processes are suitable. Good results may be obtained when the galvanizing process parameters comprise one or more of:

(a) direct current with a current density of 10–100 A/dm$^2$, preferably 30–70 A/dm$^2$;

(b) bath temperature 20–70° C., preferably 40–60° C.;

(c) treatment time 5–90 s, preferably 10–40 s;

(d) electrolyte composition comprising zinc sulphate with 30–200 g/l zinc, preferably 60–120 g/l;

(e) acidity of the electrolyte pH<4, preferably approximately pH 2.5.

Using these parameters, a well-bonded layer comprising essentially zinc may be applied to the pretreated aluminum sheet, the bonding remaining effective under a large deformation of the galvanized aluminum sheet. A further advantage is that it is possible to perform a continuous process. With a pH of approximately 2.5 it is possible to buffer the electrolyte, thereby making the electrolytic galvanizing process considerably more stable.

The electrolyte composition used is not limited to a composition comprising a sulphate solution, and for example a chloride solution may also be applied.

According to a preferred version of the first method of the invention, wherein the pretreatment comprises electrolytic graining followed by a brief anodization after which the aluminum sheet is electrolytically galvanized, desirably the same electrolyte liquid bath is not used for the anodizing as for the galvanizing. Working with a continuous process operation, but one in which the electrolytes for the anodizing and the galvanizing are separate, has the advantage that the two process conditions may be controlled independently. Thus for the anodizing process preferably a pH<2 is used, and for the electrolytic galvanizing preferably a pH of approximately 2.5. Moreover, the electrolyte for the anodizing may comprise either zinc sulphate or an iron sulphate, and also such metals as Ni or Cu, while the electrolyte for the galvanizing is preferably zinc sulphate.

Both methods in accordance with the invention are preferably carried out in a continuous process, although it is possible to carry them out batchwise.

As mentioned, the methods in accordance with the invention are suitable for galvanizing aluminum sheets made of aluminum and a wide range of aluminum alloys, such as aluminum alloys of the 1xxx type, the 3xxx type, and the 6xxx type, but also of the 2xxx type and the 5xxx type (AA designations).

The zinc layer applied in the methods of the invention may be essentially a pure zinc layer or may be primarily zinc but including minor amounts of impurity elements or deliberately added elements, as is known in the art. Typically such impurity elements or added elements are present at less than 10%, more usually less than 5% by weight in the zinc layer.

Another advantage of the methods in accordance with the invention is that the galvanized aluminum sheet which is produced has an atmospheric corrosion resistance almost comparable to that of zinc sheet, which has been used for application in building structures. This enables structures to be made lighter while retaining the good corrosion resistance. Moreover, the total zinc consumption when using galvanized aluminum sheet in building structures is considerably less than when using zinc sheets.

The invention also consists in the galvanized aluminum sheet produced by the methods according to the invention.

In a further aspect galvanized aluminum sheet, obtained by either method, may be used in building systems such as facade and roofing structures, and windowsill structures. Galvanized aluminum sheet suitable for application in building systems such as those known under the trade names KAL-ZIP and KAL-BAU may be obtained by the invention. In the case of application of the galvanized aluminum sheet in building structures, the aluminum sheet preferably comprises a weight per unit area of applied zinc in the range of 10–300 g/m$^2$, and more preferably 30–100 g/m$^2$.

In another aspect galvanized aluminum sheet, obtained by either method, may be used in shaping applications such as for the manufacture of automotive body parts by pressing. In the case of use of the galvanized aluminum sheet as automotive body sheet, the aluminum sheet preferably comprises a weight per unit area of applied zinc in the range 5–100 g/m$^2$, and more preferably in the range 5–40 g/m$^2$.

BEST MODES OF CARRYING OUT THE INVENTION

The invention will now be illustrated by several non-limitative examples.

EXAMPLE 1

Aluminum sheets manufactured from an AA3004 alloy suitable for application in building structures were pretreated and electrolytically galvanized in different ways in batch processes. The bonding of the applied zinc layer was then tested by the so-called tape method. This is a rapid method for testing bonding. A piece of tape or self-adhesive tape, for example such as that used in offices, is stuck onto the galvanized aluminum sheet and then pulled off again by hand. A value assessment is then given to the bondability by allocating a number where: (1)=excellent, (2)=good, (3)=fair, (4)=poor, (5) very poor. For value assessments (1) and (2) the bonding was also tested using the known zero bending test and the known lock-form test. For value assessments (3) to (5) these supplementary bond tests were omitted. The galvanized aluminum sheets with value assessments of (1) or (2) were also tested for durability in a corrosive, maritime industrial environment.

Table 1 gives the main process parameters used and the value assessment for the bond. Between the different steps of the pretreatment and the galvanizing the aluminum sheets were rinsed with distilled water for at least 5 s.

The degreasing in tests (1) to (14) was carried out using Percy 6340-29 (trade name) produced by Henkel Metall Chemicals, concentration 10 g/l, treatment time 3 s, bath temperature approximately 65° C., direct current with a current density of approximately 10 A/dm$^2$.

The pickling in tests (1), (2), (9), (11) and (12) was carried out in an HCl environment (8% HCl solution) pH=1, treatment time approximately 5 s. In tests (6) and (7) an 8% $H_2SO_4$ solution was used and a treatment time of approximately 5 s.

The graining in tests (3) to (5) was carried out in 1% HCl solution having a pH of about 1, bath temperature approximately 40° C., alternating current of approximately 50 Hz, current density of approximately 50 A/dm$^2$ and variable treatment time.

The anodizing in tests (5), (7) to (9), (12) and (16) was carried out with direct current, current density approximately 50 A/dm$^2$, polarity positive, treatment time approximately 5 s, a $ZnSO_4.H_2O$ electrolyte comprising approximately 90 g/l zinc, pH=1.8, bath temperature approximately 50° C. In tests (10) and (11) the electrolyte comprised sulphuric acid, other parameters were identical to test (5), except that the temperature was approximately 70° C. In tests (13) and (14) sulphuric acid and phosphoric acid respectively were used for the electrolyte, pH=1.8, bath temperature approximately 60° C., stainless steel electrode material, alternating current, electrolysis time approximately 2 s, current density approximately 2 A/dm$^2$, total immersion time approximately 10 s.

In tests (15) to (17) the pretreatment was carried out by connecting the aluminum sheet A-C-A-C, electrolysis time per polarity approximately 3 s, bath temperature approximately 20° C., current density approximately 5 A/dm$^2$, immersion time approximately 10 s, composition of electrolyte 100 g/l NaOH and 10 g/l ZnO. The thickness of the zinc layers formed by this zincate treatment were in the range 0.1 to 0.5 g/m$^2$. In test (16) the aluminum sheet was anodized in addition to that treatment.

In tests (1) to (16) the aluminum sheets were electrolytically galvanized in a zinc sulphate electrolyte with 90 g/l zinc, pH approximately 2, direct current with a current density of approximately 50 A/dm$^2$, bath temperature approximately 50° C., immersion time approximately 20 s. In test (17) the pH was approximately 2.5, other parameters being identical to tests (1) to (16). The electrolytically applied zinc layer was approximately 35 g/m$^2$.

It may be inferred from the results given in Table 1 that a pretreatment consisting of degreasing and pickling (tests 1, 2 and 6) is insufficient to obtain a well-bonded layer comprising zinc.

A pretreatment consisting of degreasing and anodizing (tests 8, 10, 13 and 14) is also insufficient to obtain a well-bonded layer comprising zinc.

industrial surrounding there was no visible difference between galvanized aluminum and pure zinc (Reinzink), while the AA3004 alloy was badly corroded particularly by the chloride. Among other things it can be inferred from the results that galvanized aluminum sheet manufactured in accordance with the invention has a durability comparable to a sheet of pure zinc.

TABLE 1

| | Degreasing | | Pickling | | Graining | | Anodizing | | | |
|---|---|---|---|---|---|---|---|---|---|---|
| Test | Temp (° C.) | Time (s) | Solution | Temp (° C.) | Solution | Time (s) | Solution | Time (s) | Galvanizing pH | Bonding rating |
| 1 | 65 | 3 | HCl | 50 | — | — | — | — | 2 | 5 |
| 2 | 65 | 3 | HCl | 80 | — | — | — | — | 2 | 5 |
| 3 | 65 | 3 | — | — | HCl | 30 | — | — | 2 | 2 |
| 4 | 65 | 3 | — | — | HCl | 5 | — | — | 2 | 3 |
| 5 | 65 | 3 | — | — | HCl | 3 | $ZnSO_4$ | 5 | 2 | 1 |
| 6 | 65 | 3 | $H_2SO_4$ | 70 | — | — | — | — | 2 | 5 |
| 7 | 65 | 3 | $H_2SO_4$ | 70 | — | — | $ZnSO_4$ | 5 | 2 | 4 |
| 8 | 65 | 3 | — | — | — | — | $ZnSO_4$ | 5 | 2 | 4 |
| 9 | 65 | 3 | HCl | 50 | — | — | $ZnSO_4$ | 5 | 2 | 5 |
| 10 | 65 | 3 | — | — | — | — | $H_2SO_4$ | 5 | 2 | 5 |
| 11 | 65 | 3 | HCl | 50 | — | — | $H_2SO_4$ | 5 | 2 | 5 |
| 12 | 65 | 3 | HCl | 80 | — | — | $ZnSO_4$ | 5 | 2 | 5 |
| 13 | 65 | 3 | — | — | — | — | $H_2SO_4$ | 2 | 2 | 4 |
| 14 | 65 | 3 | — | — | — | — | $H_3PO_4$ | 2 | 2 | 4 |
| 15 | | | Alkaline solution | | | | — | — | 2 | 1 |
| 16 | | | containing zinc + | | | | $ZnSO_4$ | 5 | 2 | 1 |
| 17 | | | A-C-A-C connection | | | | — | — | 2.5 | 1 |

The combination of in succession degreasing, pickling and anodizing (tests 7, 9, 11 and 12) was also insufficient to obtain a well-bonded layer comprising zinc.

Very good results were obtained when the aluminum sheet was electrolytically grained following the degreasing (tests 3 to 5). The best results were achieved with the method in accordance with test (5), in which anodizing followed the graining.

Very good results were also obtained when the aluminum sheet was pretreated in an alkaline environment comprising zinc while being A-C-A-C connected (tests 15 to 17). Good results were also obtained if, following on from that, an anodization step carried out (test 16).

The galvanized aluminum sheets obtained with the method in accordance with tests (3), (5) and (15) to (17) were also subjected to the zero bending test and the lock-form test. In all cases the bond of the zinc layer and the aluminum sheet remained intact.

Galvanized aluminum sheets manufactured with the method in accordance with tests (3), (5) and (15) to (17) were locally greatly deformed in such a way that the galvanized aluminum sheets were comparable in shape to KAL-ZIP and KAL-BAU. These galvanized aluminum sheets were then tested for durability by means of the Atmospheric Building Corrosion Test as described by B. Boelen in the article "New Product Test: The Atmospheric Building Corrosion Test (ABC Test)", published on the occasion of the ECCA Autumn Congress in Brussels on Nov. 27–28, 1995, and compared with untreated sheets of AA3004 alloy and pure zinc. After 6 weeks in a maritime

EXAMPLE 2

The process as described in test 5 of Example 1 was further performed in eight test runs on a continuous pilot line using AA3004 sheet material 0.26 m wide.

The process parameters used for the eight different test runs are listed in Table 2. In between graining and anodizing also the sheet was rinsed with distilled water.

The galvanized sheet which was obtained was tested for the amount of zinc layer, and the bonding was tested using the zero bending test.

Degreasing was performed in a tank with 10 g/l of Percy 6340-29 (trade name), with a direct current. After degreasing, a rinse step was performed. Electrolytic graining was carried out in 1% HCl solution, with alternating current of 50 Hz. Rinsing with distilled water followed.

Anodizing was performed in a tank with an electrolyte having a pH of about 2 comprising 400 g/l $ZnSO_4.H_2O$ (resulting in about 90–100 g Zn/l), and 30 g/l $Al_2SO_4.nH_2O$, and 30 g/l $H_3BO_3$, and with a direct current. The $H_2BO_3$ was added to act as a buffer.

The galvanizing was performed in a separate tank, but with the same electrolytic composition as used for anodising. A rinsing step followed.

From the results of Table 2 it can be seen that all the galvanized sheet material had excellent bonding when tested in a zero bending test. It can also be seen that the line speed, and hence the treatment time, is an important process parameter for the amount of zinc coating on the aluminum sheet. At a line speed of 6 m/min (as in Run 5) the contact times for the various treatment steps were as follows: degreasing 3 s (repeated four times), graining 5 s, anodizing 5 s, and galvanizing 24 s. The contact times at other line speeds can be calculated from these values.

Depending on the local conditions a skilled person can therefore find various optima for the process parameters depending on the amount of galvanized zinc required on the aluminum sheet.

TABLE 2

| | | Degrease | | | Graining | | Anodizing | | Galvanizing | | | | |
|---|---|---|---|---|---|---|---|---|---|---|---|---|---|
| Run | Line speed (m/min) | Temp. (° C.) | Current density (A/dm$^2$) | Rinse Temp. (° C.) | Temp. (° C.) | Current density (A/dm$^2$) | Temp (° C.) | Current density (A/dm$^2$) | Temp. (° C.) | Current density (A/dm$^2$) | Rinse Temp. (° C.) | Zinc coating (g/m$^2$) | Bonding rating |
| 1 | 4 | 65 | 15 | 51 | 51 | 29 | 52 | 7.7 | 50 | 9.6 | 52 | 8.0 | 1 |
| 2 | 12 | 65 | 12.8 | 46 | 53 | 29 | 52 | 15.3 | 51 | 32 | 52 | 5.5 | 1 |
| 3 | 4 | 65 | 12.8 | 43 | 54 | 23 | 51 | 15.3 | 51 | 32 | 52 | 14.5 | 1 |
| 4 | 2 | 65 | 12.8 | 41 | 57 | 23 | 51 | 7.7 | 51 | 32 | 52 | 30.5 | 1 |
| 5 | 6 | 66 | 12.8 | 37 | 52 | 19 | 52 | 11.5 | 52 | 32 | 53 | 26.0 | 1 |
| 6 | 4 | 66 | 12.8 | 41 | 48 | 19 | 51 | 11.5 | 54 | 32 | 53 | 25.5 | 1 |
| 7 | 2 | 66 | 12.8 | 46 | 45 | 19 | 51 | 7.7 | 56 | 32 | 52 | 38.0 | 1 |
| 8 | 4 | 66 | 12.8 | 49 | 45 | 38 | 52 | 14.2 | 58 | 32 | 52 | 41.0 | 1 |

What is claimed is:

1. A method for applying a layer comprising zinc onto at least one surface of an aluminum or aluminum alloy sheet, comprising the steps of pretreating said surface and applying the layer by electrolytic galvanizing, wherein the pretreating step comprises electrochemical graining of said surface, in which the pretreating step comprises anodizing said surface after the electrochemical graining.

2. A method according to claim 1 in which the electrochemical graining is performed in a solution having a pH less than 3 and in which an alternating current is applied between the sheet and an electrode.

3. A method according to claim 2 in which the electrochemical graining is performed using a current density in the range 5 to 200 A/dm$^2$.

4. A method according to claim 2 in which the alternating current frequency is from 10 to 1000 Hz.

5. A method according to claim 1 in which the duration of the electrochemical graining is from 0.2 to 60 s.

6. A method according to claim 1 in which the galvanizing is performed using a direct current having a current density of from 10 to 100 A/dm$^2$, a bath temperature of from 20 to 70° C., a treatment time of from 5 to 90 s, an electrolyte composition comprising zinc sulphate having an amount of zinc from 30 to 200 g/l, and an electrolyte pH of less than 4.

7. An aluminum or aluminum alloy sheet having an electrolytically applied layer comprising zinc in which said layer is adjacent to an aluminum or aluminum alloy surface roughened by electrochemical graining in accordance with claim 1.

8. A method for applying a layer comprising zinc onto at least one surface of an aluminum or aluminum alloy sheet, comprising the steps of pretreating said surface and applying said layer by electrolytic galvanizing, said pretreating step including applying a preliminary layer comprising zinc onto said surface, wherein the application of said preliminary layer comprises (i) immersing said surface in a zinc-containing alkaline solution, (ii) applying a potential to the sheet to cause an electrolytic current to flow with a current density during the application of said preliminary layer from 0.5 to 20 A/dm$^2$, and (iii) reversing the polarity of said potential at least once, in which said pretreating step includes anodizing said surface after applying said preliminary layer.

9. A method according to claim 8 in which the preliminary layer is applied in an amount of from 0.1 to 0.5 g/m$^2$.

10. A method according to claim 8 in which said polarity of said potential is reversed at least twice.

11. A method according to claim 10 in which the time interval between each two adjacent polarity reversals is at least 0.5 s.

12. A method according to claim 8 in which during the application of said potential, said sheet is initially an anode and is finally a cathode.

13. A method according to claim 8 in which said zinc-containing alkaline solution comprises from 10 to 300 g/l of NaOH and from 2 to 40 g/l of ZnO.

14. A method according to claim 8 in which said electrolytic galvanizing is performed with a direct current having a current density of from 10 to 100 A/dm2, a bath temperature of from 20 to 70° C., a treatment time of from 5 to 90 s, an electrolyte composition comprising zinc sulphate in an amount of zinc from 30 to 200 g/l, and an electrolyte pH of less than 4.

15. An aluminum or aluminum alloy sheet having an electrolytically applied layer comprising zinc, produced by a method in accordance with claim 8.

16. A building sheet which is a roofing sheet comprising an aluminum or aluminum alloy sheet having an electrolytically applied layer comprising zinc, produced by a method for applying the layer comprising zinc onto at least one surface of the aluminum or aluminum alloy sheet, comprising the steps of:

pretreating said surface and applying said layer by electrolytic galvanizing, said pretreating step including applying a preliminary layer comprising zinc onto said surface, wherein the application of said preliminary layer comprises (i) immersing said surface in a zinc-containing alkaline solution, (ii) applying a potential to the sheet to cause an electrolytic current to flow with a current density during the application of said preliminary layer from 0.5 to 20 A/dm$^2$, and (iii) reversing the polarity of said potential at least once, in which the weight of said layer comprising zinc is from 10 to 300 g/m$^2$.

17. A building sheet according to claim 16 in which the weight of said layer comprising zinc is from 30 to 100 g/m$^2$.

18. A method for applying a layer comprising zinc onto at least one surface of an aluminum or aluminum alloy sheet, comprising the steps of:

pretreating said surface; and applying the layer by electrolytic galvanizing;

wherein the pretreating step comprises electrochemical graining of said surface, subsequently followed by applying a preliminary layer comprising zinc onto said surface, wherein the application of said preliminary layer comprises (i) immersing said surface in a zinc-containing alkaline solution, (ii) applying a potential to the sheet to cause an electrolytic current to flow with a current density during the application of said preliminary layer from 0.5 to 20 $A/dm^2$, and (iii) reversing the polarity of said potential at least once, wherein said pretreating step includes anodizing said surface at a time selected from the group consisting of after applying said preliminary layer and after the electrochemical graining.

19. An aluminum or aluminum alloy sheet having an electrolytically applied layer comprising zinc produced by a method in accordance with claim 18.

20. A building sheet comprising an aluminum or aluminum alloy sheet according to claim 19 in which the weight of said layer comprising zinc is from 10 to 300 $g/m^2$.

21. An aluminum or aluminum alloy sheet having an electrolytically applied layer comprising zinc produced by a method in accordance with claim 1.

22. A building sheet comprising an aluminum or aluminum alloy sheet according to claim 21 in which the weight of said layer comprising zinc is from 10 to 300 $g/m^2$.

23. A building sheet, which is a roofing sheet, comprising an aluminum or aluminum alloy sheet having an electrolytically applied layer comprising zinc in which said layer is adjacent to an aluminum or aluminum alloy surface roughened by electrochemical graining, wherein the layer is applied by a method, comprising the steps of pretreating said surface and applying the layer by electrolytic galvanizing, wherein the pretreating step comprises the electrochemical graining of said surface, in which the weight of said layer comprising zinc is from 10 to 300 $g/m^2$.

* * * * *